US012320570B2

(12) United States Patent
Knatt et al.

(10) Patent No.: US 12,320,570 B2
(45) Date of Patent: Jun. 3, 2025

(54) ICE BIN WITH MAGNETIZED SCOOP AND METHOD OF MANUFACTURE AND USE

(71) Applicant: True Manufacturing Company, Inc., O'Fallon, MO (US)

(72) Inventors: Kevin Knatt, O'Fallon, MO (US); Curt Cayemberg, O'Fallon, MO (US)

(73) Assignee: True Manufacturing Company, Inc., O'Fallon, MO (US)

( * ) Notice: Subject to any disclaimer, the term of this patent is extended or adjusted under 35 U.S.C. 154(b) by 657 days.

(21) Appl. No.: 17/318,486

(22) Filed: May 12, 2021

(65) Prior Publication Data

US 2022/0364779 A1 Nov. 17, 2022

(51) Int. Cl.
*F25C 5/182* (2018.01)
*F25C 5/04* (2006.01)

(52) U.S. Cl.
CPC ..... *F25C 5/043* (2013.01); *F25C 5/182* (2013.01); *F25C 2500/02* (2013.01)

(58) Field of Classification Search
CPC .... F25C 5/00; F25C 5/043; F25C 5/24; F25C 5/182; F25C 2500/02; F25D 2331/809; F25D 23/067; F25D 23/064
See application file for complete search history.

(56) References Cited

U.S. PATENT DOCUMENTS 6,068,228 A 5/2000 Kobayashi et al.
6,250,696 B1 6/2001 Baker
6,742,821 B2 6/2004 Kleinpell
7,043,844 B2 5/2006 Lin
7,503,212 B2 3/2009 Piazza et al.
8,505,420 B2 8/2013 Alfaro
8,726,525 B2 5/2014 Bagley et al.
9,187,224 B1 11/2015 Mazzilli et al.
9,493,271 B2 11/2016 Gillie
10,279,980 B2 5/2019 James, Jr.
(Continued)

FOREIGN PATENT DOCUMENTS

CN 2578055 Y 10/2003
CN 201658164 U 12/2010
(Continued)

OTHER PUBLICATIONS

English language translation of JP20130879 to Hideki. Translated Nov. 2023 (Year: 2013).*
(Continued)

*Primary Examiner* — Cassey D Bauer
(74) *Attorney, Agent, or Firm* — Stinson LLP

(57) ABSTRACT

An ice bin and scoop and related methods are disclosed. The ice bin includes a liner in an outer shell. A support plate is fitted in a space between the liner and the outer shell. The support plate has either ferromagnetic or magnetic material. The scoop has either magnetic or ferromagnetic material. The support plate is positioned so that the scoop can be supported inside the ice bin on the perimeter wall of the ice bin by a force of magnetic attraction between the support plate and the scoop. The support plate is positioned so that the scoop may be held out of contact with ice deposited in the bin and out of the path of falling ice. Molded-in-place insulation may support the support plate in the space between the liner and outer shell.

27 Claims, 19 Drawing Sheets

(56) References Cited

U.S. PATENT DOCUMENTS

| | | | |
|---|---|---|---|
| 2005/0056655 | A1 | 3/2005 | Gary |
| 2005/0236406 | A1 | 10/2005 | Aisenbrey |
| 2005/0252291 | A1 | 11/2005 | Dalla Piazza et al. |
| 2012/0280525 | A1 | 11/2012 | Tharp |
| 2015/0251812 | A1 | 9/2015 | Gillie |
| 2017/0121075 | A1 | 5/2017 | Gonzalez |
| 2018/0058743 | A1 | 3/2018 | Vorosmarti, III et al. |

FOREIGN PATENT DOCUMENTS

| | | | |
|---|---|---|---|
| CN | 204963371 | U | 1/2016 |
| EP | 0874203 | A2 | 10/1998 |
| JP | 2004057227 | A | 2/2004 |
| JP | 2004121792 | A | 4/2004 |
| JP | 2004202612 | A | 7/2004 |
| JP | 2013087996 | A | 5/2013 |

OTHER PUBLICATIONS

English Language Translation of JP2004057227 to Miyaguchi. Translated May 2024 (Year: 2004).*
Extended European Search Report from EP Application No. 22172623.5, mailed Sep. 22, 2022, 25 pages.

* cited by examiner

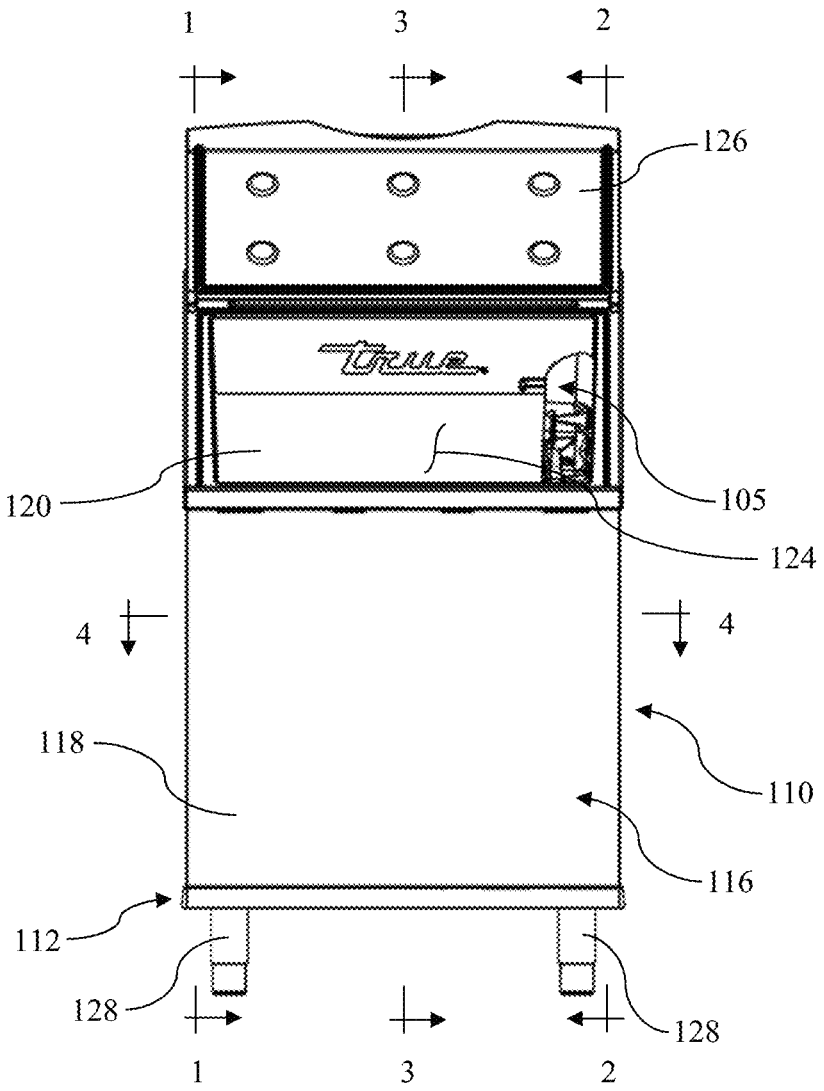
FIG. 2
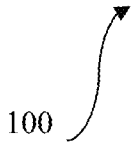

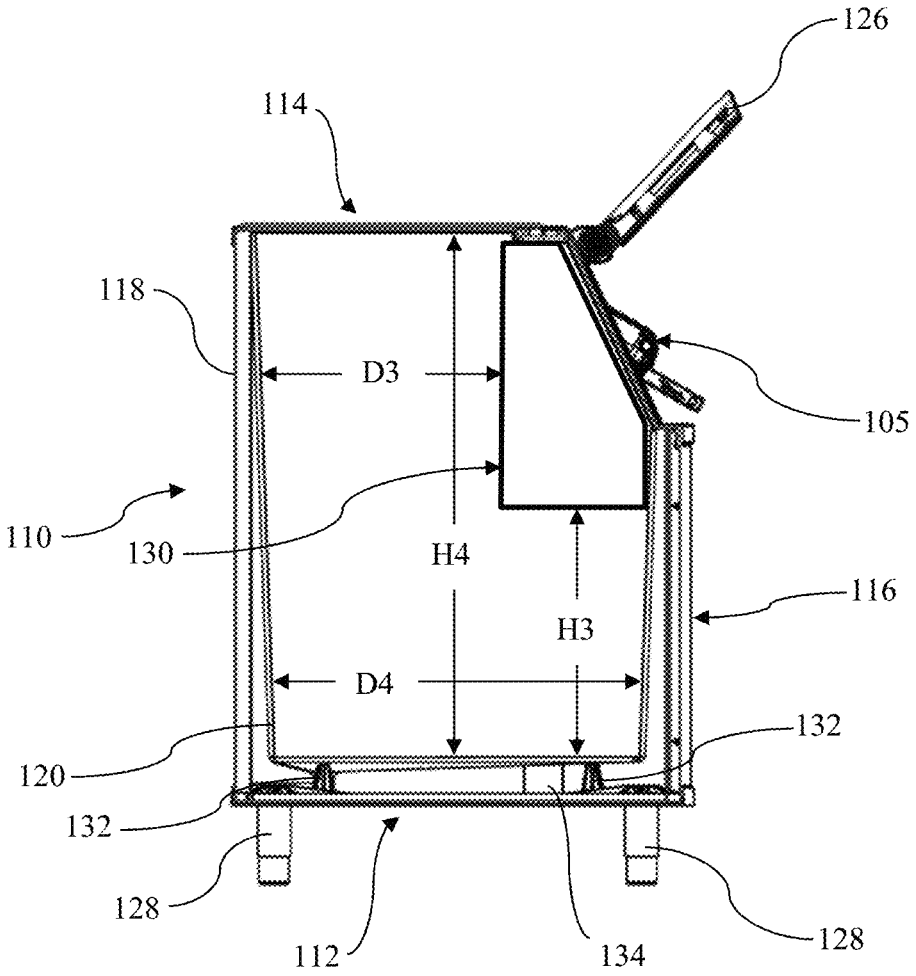
FIG. 3
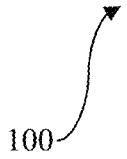

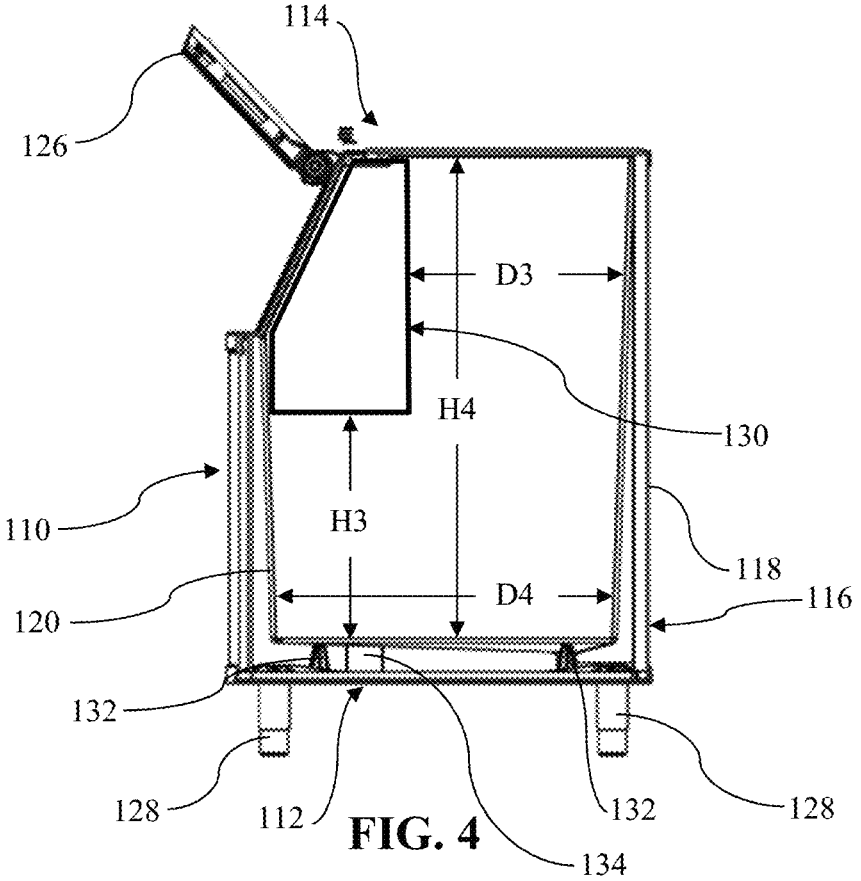
FIG. 4
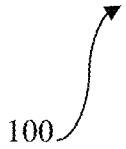

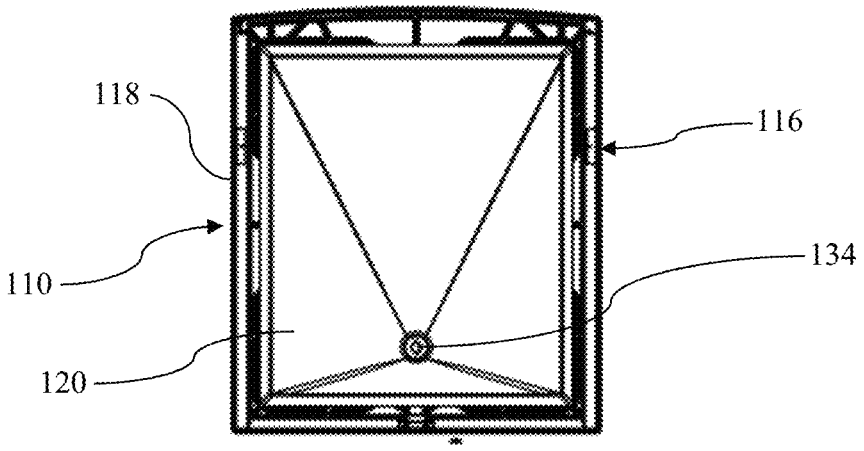
FIG. 7
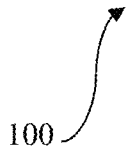

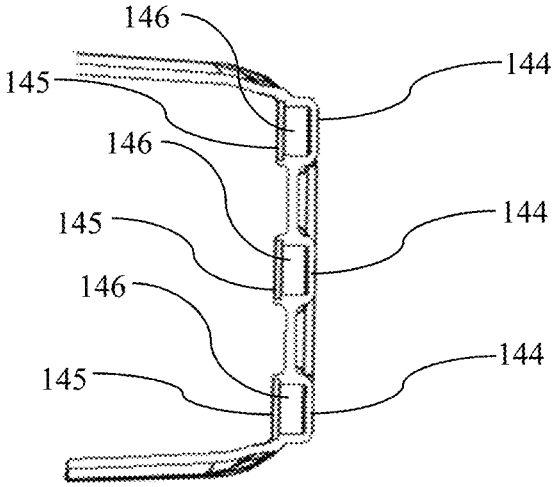
FIG. 9
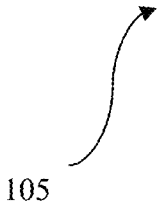

ICE BIN WITH MAGNETIZED SCOOP AND METHOD OF MANUFACTURE AND USE

FIELD

The present disclosure generally relates to ice bins and ice scoops.

BACKGROUND

Ice bins are used to receive ice from an ice maker and store the ice until the ice is used. Ice bins often include a scoop for retrieving ice stored out of the bin without direct contact between ice and the user's hands. Scoops are typically placed on top of the ice when not in use. By putting an ice scoop on top of the ice, the scoop has a tendency to become cold to the user's touch, especially if the scoop has been in the bin for a significant amount of time. Further, when the scoop is placed on top of the ice during non-use, the creation of new ice has a tendency to bury the ice scoop, making it difficult for the user to find and requiring the user to dig through the ice, causing the user to become cold and potentially contaminating the ice.

SUMMARY

In one aspect, an ice bin comprising a bin body is disclosed. The bin body comprises a lower portion, an upper portion, and a perimeter wall extending height-wise from the lower portion to the upper portion. The upper portion of the bin body defines an ice drop opening configured so that ice dropped from an ice maker supported above the ice bin is passable through the ice drop opening into the interior of the ice bin. The bin body further comprises an ice retrieval opening spaced apart from the ice drop opening for providing access to the interior of the ice bin. The perimeter wall also comprises a support plate configured to support an ice scoop on the interior of the perimeter wall by a magnetic force between the ice scoop and the support plate.

In another aspect, an ice storage and retrieval assembly comprising an ice bin is disclosed. The ice bin comprises a bin body, the bin body comprising a lower portion, an upper portion, and a perimeter wall extending height-wise from the lower portion to the upper portion. The upper portion of the bin body defines an ice drop opening configured so that ice dropped from an ice maker supported above the ice bin is passable through the ice drop opening into the interior. The bin body further comprises an ice retrieval opening spaced apart from the ice drop opening for providing access to the interior of the ice bin. The perimeter wall comprises a support plate for supporting an ice scoop comprising at least one magnetic element. The scoop is configured to support itself on the perimeter wall at a location in the interior of the ice bin overlying the support plate by a magnetic force between the ice scoop and the support plate.

In yet another aspect, a method of manufacturing an ice bin is disclosed. The method includes forming a liner and an outer shell of the ice bin, fitting the liner into the outer shell, fitting the support plate between the liner and the outer shell temporarily using an adhesive, and foaming the area between the liner and the outer shell with an insulation layer to permanently secure the support plate in position.

In another aspect, a method of using an ice bin and scoop is disclosed. The method includes first detaching the scoop from an inner surface of the ice bin by overcoming a magnetic force between the scoop and the ice bin by which the scoop is supported on the inner surface of the ice bin.

Second, scooping ice that has been deposited by an ice maker into the bin out of the ice bin with the scoop. Third, reattaching the scoop to the inner surface of the ice bin such that the scoop is supported on the inner wall by a magnetic force between the scoop and the inner surface of the ice bin.

In another aspect, a method of making a scoop is disclosed. The method comprises forming a scoop comprising a magnet receiving enclosure having an open end, placing a magnet element into the magnet receiving enclosure through the open end, and joining a cap to the scoop over the open end of the magnet receiving enclosure such that the cap retains the magnetic element in the enclosure.

In another aspect, an ice maker appliance is disclosed. The ice maker appliance comprises an ice bin comprising a bin body and a front door assembly. The front door assembly comprises a shell, a liner, and a support plate. The ice maker further comprises an ice scoop comprising at least one magnetic or ferromagnetic element. The scoop is configured to be releasably supported on the front door assembly by a force of magnetic attraction between the ice scoop and the support plate.

Other objects and features of the present disclosure will be in part apparent and in part pointed out herein.

BRIEF DESCRIPTION OF THE DRAWINGS

FIG. 2 is a front view of an ice bin and scoop;

FIG. 3 is a cross section taken through the plane of line 1-1 of FIG. 2;

FIG. 4 is a cross section taken through the plane of line 2-2 of FIG. 2;

FIG. 7 is a cross section taken through the plane of line 4-4 of FIG. 2;

FIG. 9 is a cross section taken through the plane of line 5-5 of FIG. 8;

Corresponding reference numbers indicate corresponding parts throughout the drawings.

DETAILED DESCRIPTION

Figure 1:
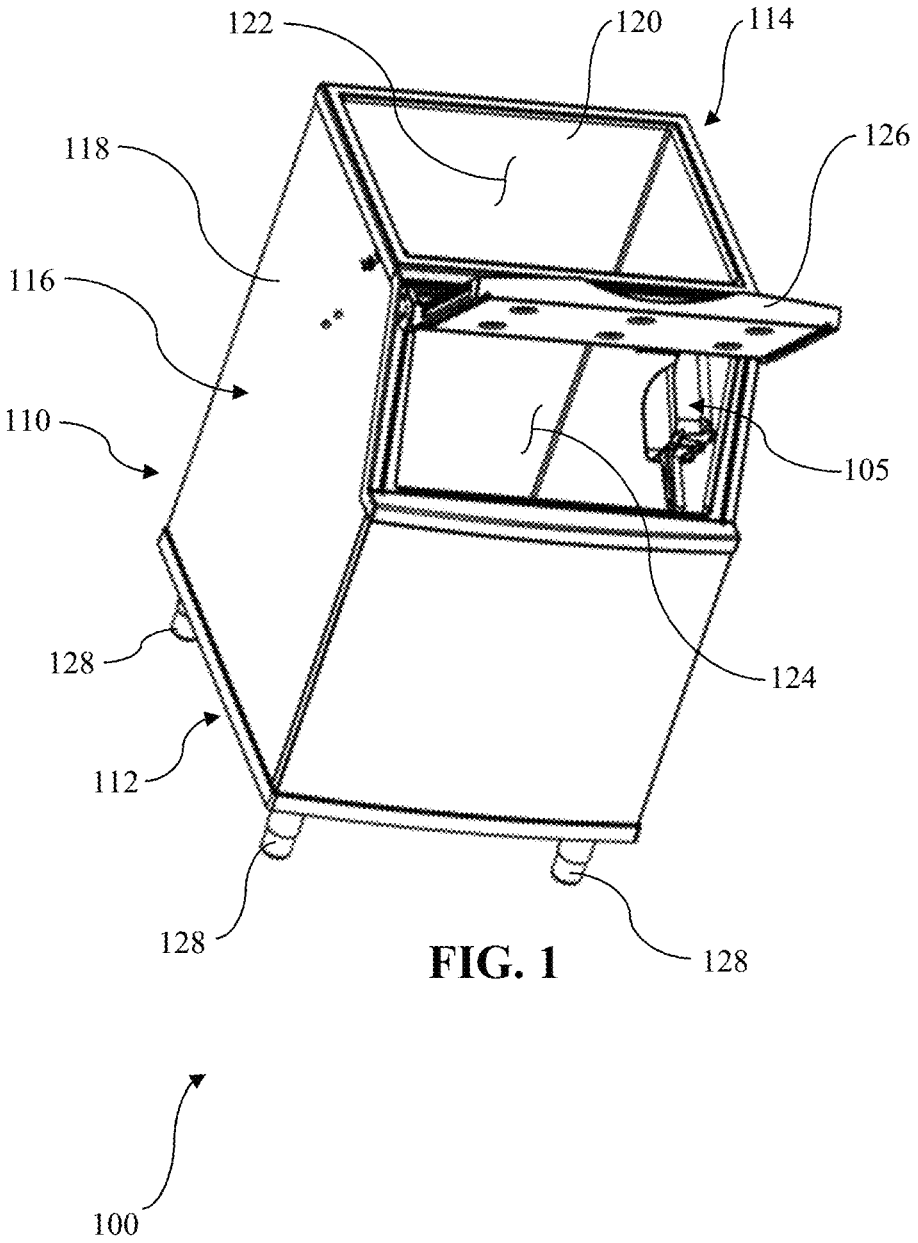
FIG. 1 is a perspective of an ice bin and scoop.

Referring to FIGS. 1 and 2, an ice bin 100 with a scoop 105 is shown. The ice bin comprises a bin body 110. The bin body is comprised of a lower portion 112, an upper portion 114, and a perimeter wall 116. The perimeter wall 116 extends heightwise from the lower portion 112 to the upper portion 114. The perimeter wall 116 further comprises an outer shell 118 and a liner 120. The liner 120 defines an inner perimeter of the perimeter wall 116 and the outer shell 118 defines an outer perimeter of the perimeter wall. The liner 120 is disposed within the outer shell 118 and further defines an interior of the ice bin 100 for ice to be held for future use.

The ice bin 100 further defines two openings, an ice drop opening 122 (broadly, ice drop area) and an ice retrieval opening 124 (broadly, ice retrieval area). The upper portion 114 surrounds the ice drop opening 122 and is configured to form a seat. The ice drop opening 122 is configured so that ice formed in an ice maker (not shown), supported above the ice bin 100 on the seat of the upper portion 114, is passable through the ice drop opening into the ice bin. Once the ice from the ice maker has passed through the ice drop opening 122, it rests in the interior of the liner 120 for future use. The ice is then retrieved from the interior of the liner 120 by a user through the ice retrieval opening 124. The ice retrieval opening is located generally at the front end of the ice bin 100, as illustrated in FIG. 1. A door 126 is configured to operatively open and close the ice retrieval opening 124. The ice bin 100 is supported off of the ground using legs 128.

Referring to FIG. 3, the left side of the outer shell 118 of the perimeter wall 116 is removed to show the area between the outer shell and the liner 120. FIG. 4 similarly shows the right side of the outer shell 118 of the perimeter wall 116 removed to show the area between the outer shell and the liner 120. The exterior surface of the liner 120 on either or both of the left or right side of the liner is configured to support a support plate 130.

In general, each support plate 130 is configured to support the scoop 105 on the inner wall of the bin 100 via a force of magnetic attraction between the support plate and the scoop. In one or more embodiments, the support plate 130 can comprise a ferromagnetic material such as galvanized steel and the scoop 105 comprises a magnetic material configured to impart a force of magnetic attraction between the ferromagnetic scoop and the support plate. In another embodiment, the support plate 130 comprises a magnet and the scoop 105 comprises ferromagnetic material such that the support plate 130 is configured to impart a force of magnetic attraction to the scoop for holding the scoop on the wall of the bin. Hereafter, an exemplary embodiment will be described wherein each support plate 130 comprises a single monolithic piece of ferromagnetic material (e.g., galvanized steel) and the scoop 105 comprises one or more magnets. However, it is now understood that the use of magnetic and ferromagnetic material as between the bin and the scoop be reversed without departing from the scope of the disclosure.

The support plate 130 is generally configured to be supported on the liner in the upper front corner of the liner 120, such that the support plate is adjacent to the ice retrieval opening 124. The illustrated support plate 130 is supported in the upper front corner of the liner 120 such that there is basically no spacing between the support plate and the front of the liner or the support plate and the top of the liner. This positioning allows for the scoop 105, further described below, to be situated away from the ice drop path and out of the ice reservoir.

Figure 5:
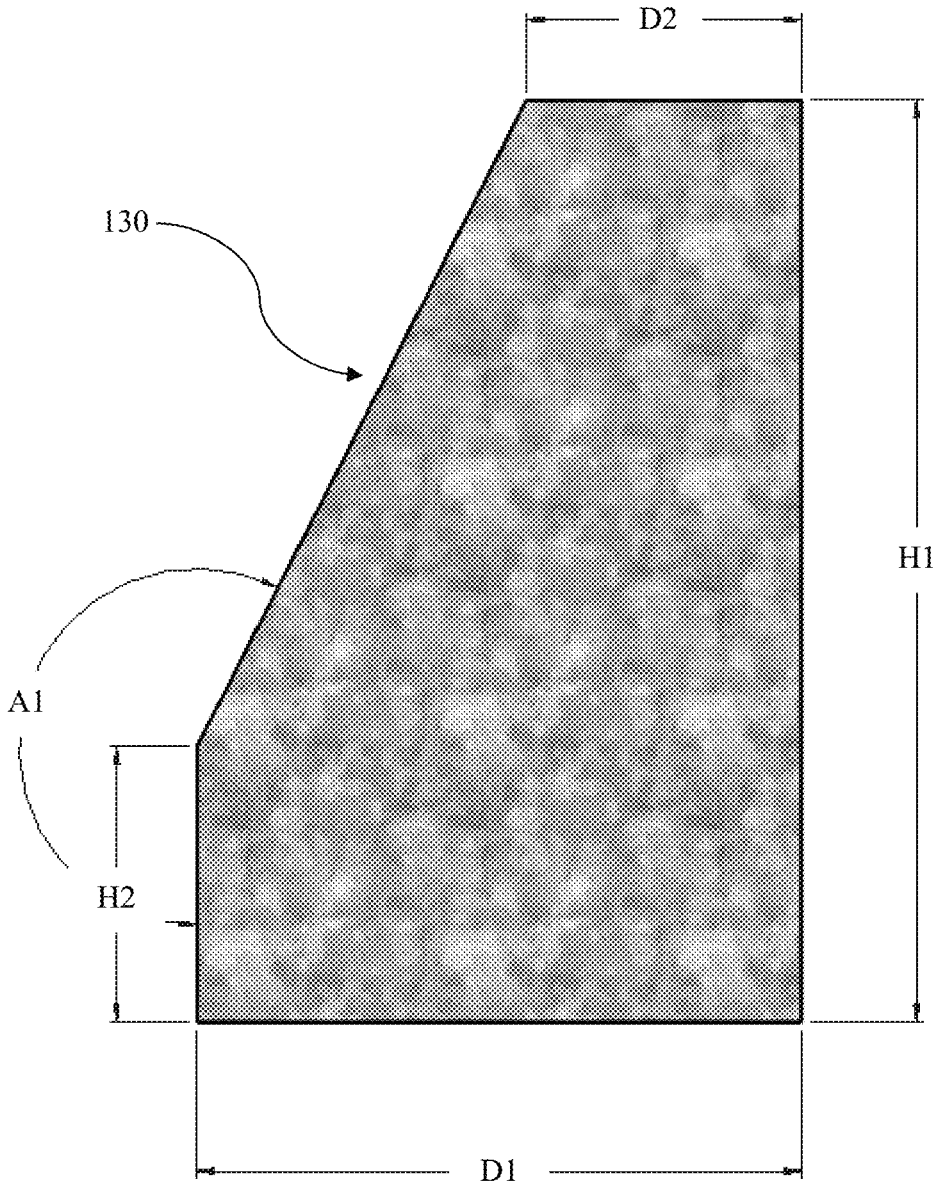
FIG. 5 is a side view of a support plate.

Referring to FIG. 5, the support plate 130 has a front-to-back depth D1 defined by a distance between a back edge margin and a front edge margin (e.g., the front-most edge margin of the support plate). In one embodiment, the front-to-back depth of the support plate 130 is in an inclusive range of from about 4 inches to about 24 inches (e.g., from about 6 inches to about 18 inches). In the illustrated embodiment, the back edge margin of the support plate 130 is spaced apart from the back of the liner 120. For example, in one or more embodiments (shown in FIGS. 3 and 4), the back edge margin of the support plate 130 is spaced apart from the back of the liner 120 by a front-to-back spacing distance D3 in an inclusive range of from about 8 inches to about 24 inches (e.g., from about 12 inches to about 18 inches). In certain embodiments, the front-to-back spacing distance is greater than the front-to-back depth D1 of the support plate. Along the front-to-back spacing distance, it is not possible for a user to support the scoop 105 magnetically on the inner wall of the bin. This is desirable because it prevents the user from positioning the scoop 105 toward the rear of the bin 100, where it might interfere with falling ice. The liner 120 itself has a front-to-back depth D4. In one or more embodiments, the front-to-back depth of the support plate D1 is in an inclusive range of from about 10% to about 75% of the front-to-back depth D4 of the liner (e.g., an inclusive range of from about 20% to about 50%). In certain embodiments, the front-to-back spacing distance D3 is in an inclusive range of from about 25% to about 90% of the depth D4 of the liner (e.g., an inclusive range of 50% to about 80%). In the illustrated embodiment, the upper front corner region of each support plate 130 is beveled to match the angle of the doorframe around the ice retrieval opening 124. Because of this bevel, the top edge margin of the plate 130 has a front-to-back depth D2 that is less than the overall front-to-back depth D1 of the plate 130. In certain embodiments, the bevel front-to-back depth D2 is an inclusive range of 10% to 90% of the front-to-back depth D1 of the support plate 130.

The support plate 130 has a top-to-bottom height H1 between a top edge margin and a bottom edge margin. In one embodiment, the top-to-bottom height H1 is in an inclusive range from about 6 inches to about 36 inches (e.g., from about 8 inches to about 30 inches). In the illustrated embodiment, the bottom edge margin of the support plate 130 is spaced apart from the bottom of the liner 120 by a top-to-bottom spacing distance H3 in an inclusive range of from about 12 inches to about 36 inches (e.g., from about 16 inches to about 30 inches). In certain embodiments, the top-to-bottom spacing distance H3 is greater than the top-to-bottom height distance H1. The liner 120 itself has a top-to-bottom height H4. In one or more embodiments, the top-to-bottom height of the support plate H1 is in an inclusive range from about 10% to about 75% of the top-to-bottom height of the liner H4 (e.g., an inclusive range of from about 20% to about 50%). In certain embodiments, the top-to-bottom spacing distance H3 is in an inclusive range of from about 25% to about 90% of the top-to-bottom height of the liner H4 (e.g., an inclusive range of 50% to about 80%). In the illustrated embodiment, the upper front corner region of each support plate 130 is beveled to match the angle of the frame around the ice retrieval opening 124. Because of this bevel, the top edge margin of the plate 130 has a height H2 below the bevel that is less than the overall height H1. In certain embodiments, the height H2 is an inclusive range of 10% to 90% of the height H1. The beveled edge defines an angle A1 with the front edge of the plate 130, measured as the outside angle between the front vertical edge and the bevel edge. In one or more embodiments, the angle A1 is in an inclusive range of from about 190° to about 260°.

Referring to FIG. 7, disposed in the area between the outer shell 118 and the liner 120 is an insulation layer (not shown). The insulation layer is molded-in-place between the liner 120 and the outer shell 118 and around the support plate 130. In one or more embodiments, the insulation layer is formed from spray foam insulation. Once molded in place, the insulation firmly holds the support plates 130 in position. But as explained more fully below, the illustrated bin 105 further comprises double sided tape (broadly, an adhesive) between the plate 130 and the liner 120 that further supports the plate on the liner, and in particular, is configured to hold the plate in place the liner prior while the foamed insulation is being molded-in-place. The insulation layer keeps the temperature inside the liner 120 close to or below freezing and slows the drift toward warmer ambient temperature.

Figure 6:
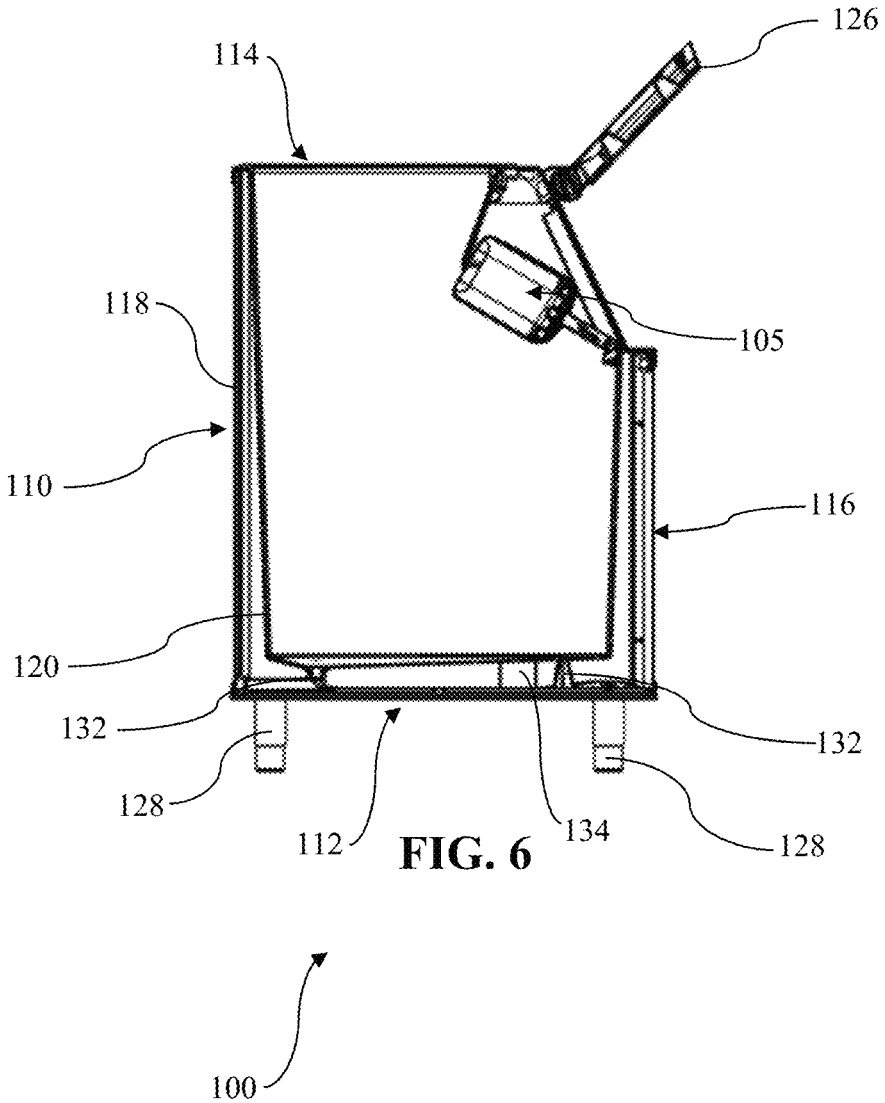
FIG. 6 is a cross section taken through the plane of line 3-3 of FIG. 2.
Figure 8:
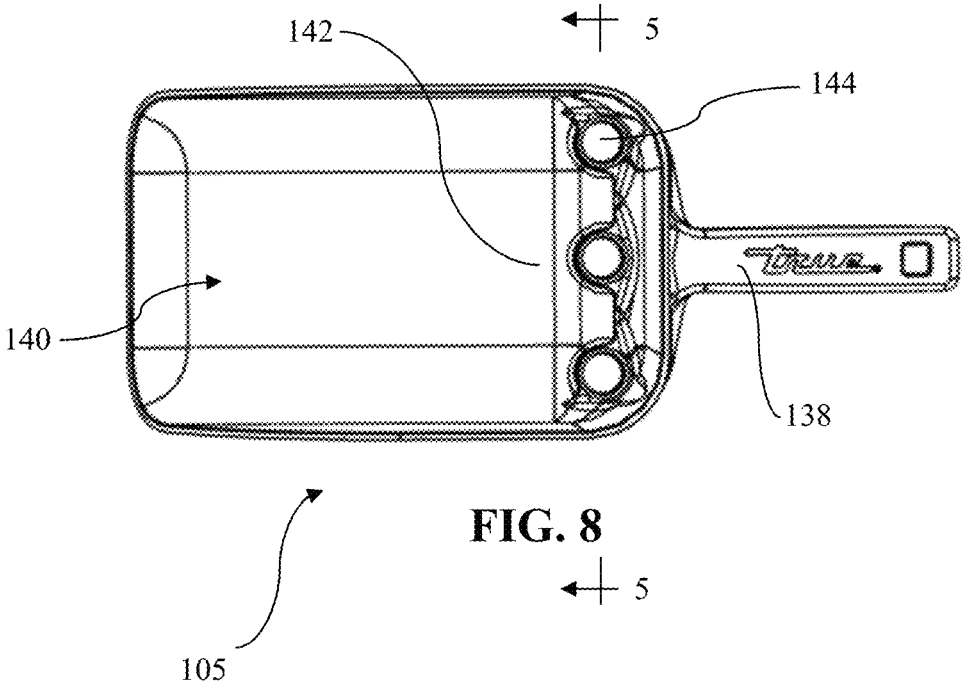
FIG. 8 is a front view of a scoop.
Figure 10:
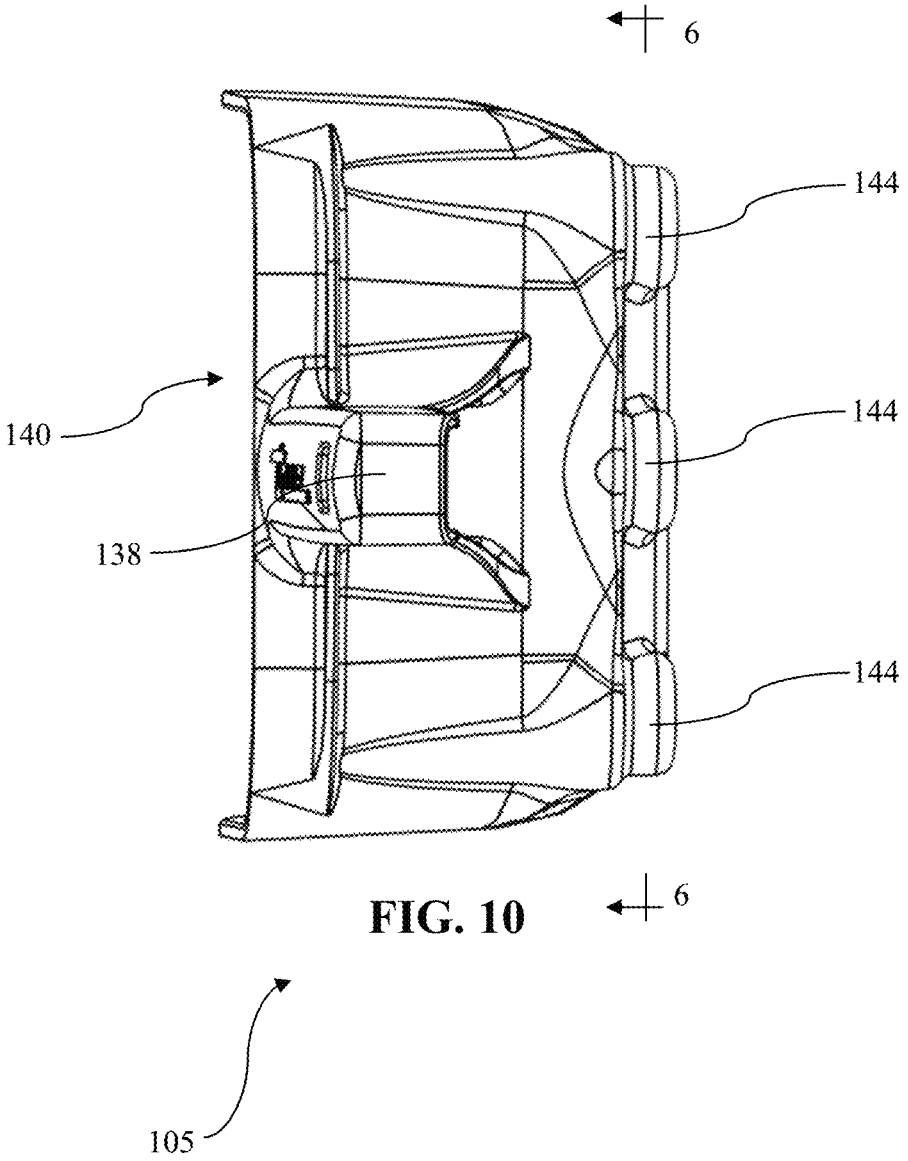
FIG. 10 is a side view of a scoop.
Figure 11:
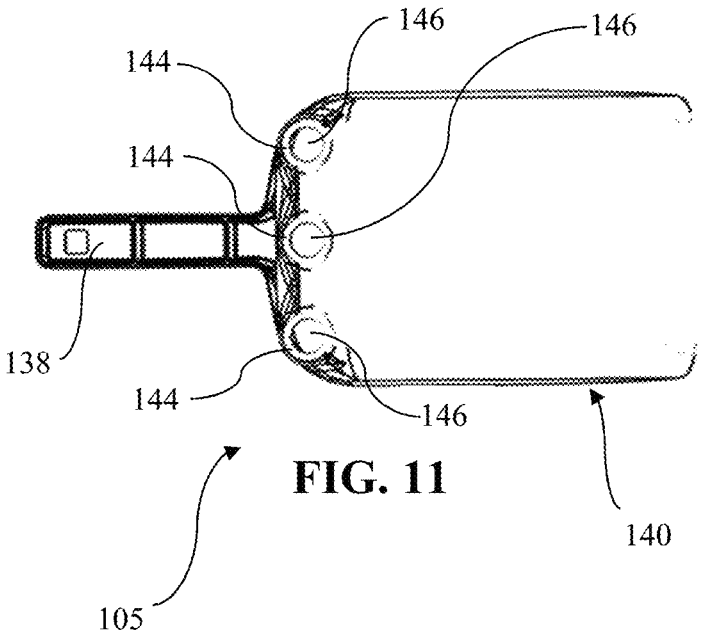
FIG. 11 is a cross section taken through the plane of line 6-6 of FIG. 10.
Figure 12:
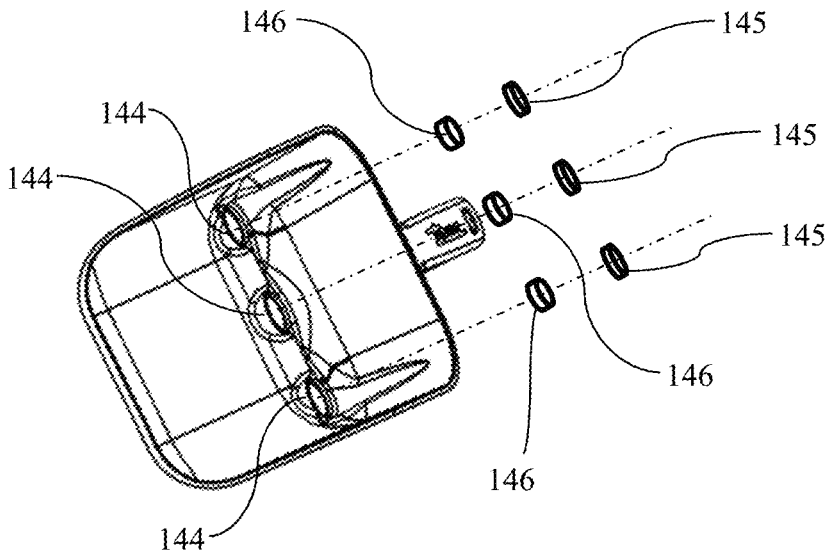
FIG. 12 is an exploded perspective of a scoop.

Referring to FIGS. 8-12, the scoop 105 comprises a handle portion 138 and a scoop portion 140. The handle portion 138 has a distal end and a proximate end. The scoop portion 140 is attached to the distal end of the handle portion 138. The scoop portion 140 defines one or more magnetic receiving enclosures 144, and a magnetic element 146 (broadly, a magnetic attraction element, which in the illustrated embodiment comprises an element formed from a magnetic material; but as explained above, could, in other embodiments, comprise an element formed from ferromagnetic material) is received in each enclosure. The enclosures 144 further comprise a cap 145, such that when the magnetic element 146 is placed into the magnet receiving enclosure, the cap is joined to the scoop 105 over the open end of the magnet receiving enclosure such that the cap retains the magnetic in the enclosure. In one embodiment, the scoop 105 is made of plastic. It is contemplated that, in an alternative embodiment, if the bin support plates 130 were to comprise magnets instead of ferromagnetic material, the entire scoop 105 could be formed from ferromagnetic material such as galvanized steel instead of forming pockets for ferromagnetic elements. The illustrated magnetic elements 146 are configured to interact with the support plate 130 in order to support the scoop 105 against the interior wall of the liner 118 of the ice bin 100 in a position overlying the support plate, as seen in FIGS. 1, 2, 6.

Figure 13:
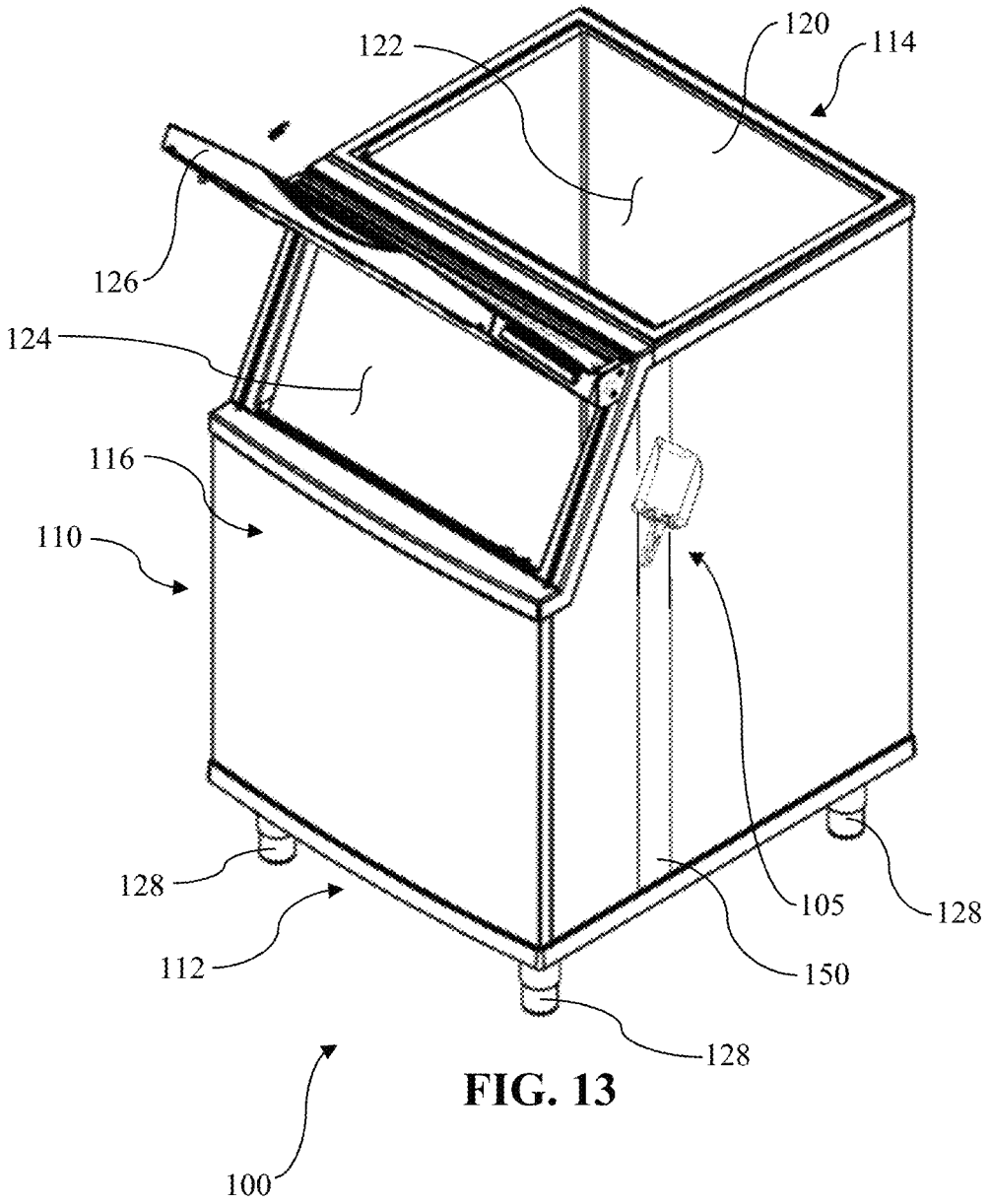
FIG. 13 is a perspective of an ice bin with the scoop at an alternate position, wherein a perimeter wall panel of an outer shell of the ice bin is shown transparent to reveal an upright support member.
Figure 14:
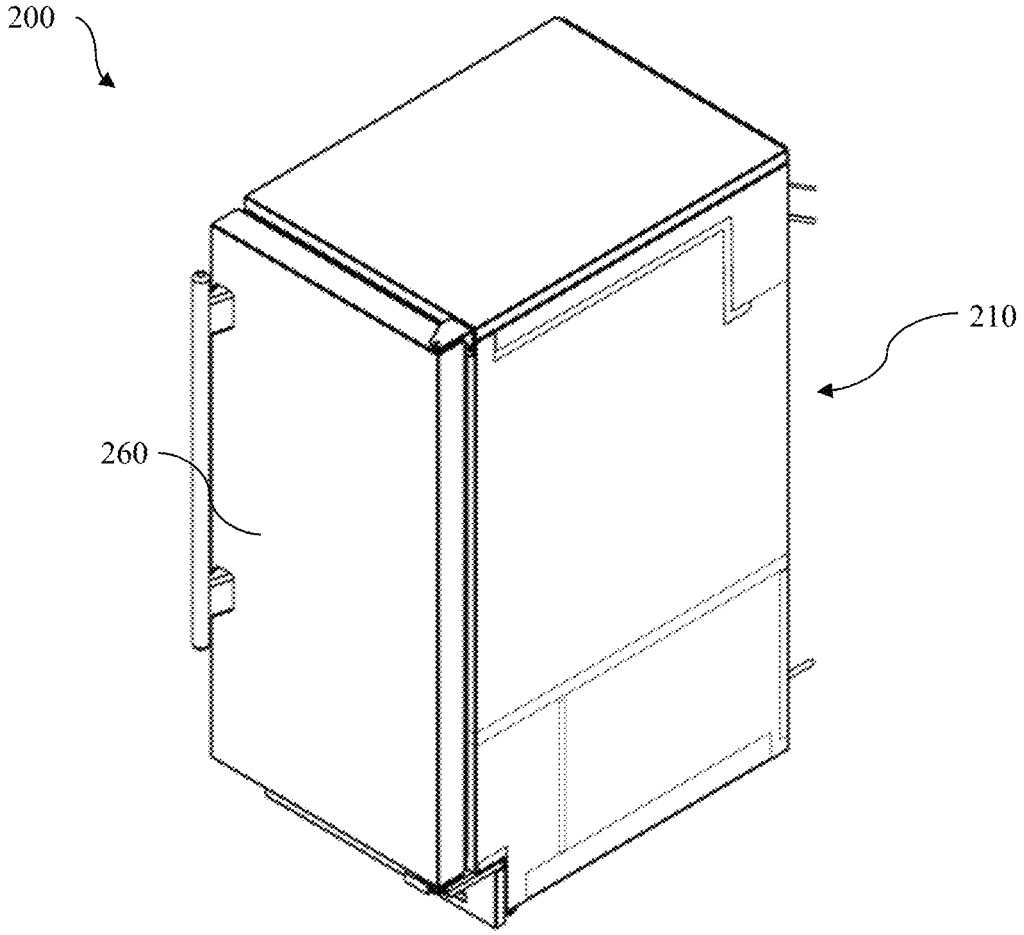
FIG. 14 is a perspective of an ice maker appliance.
Figure 15:
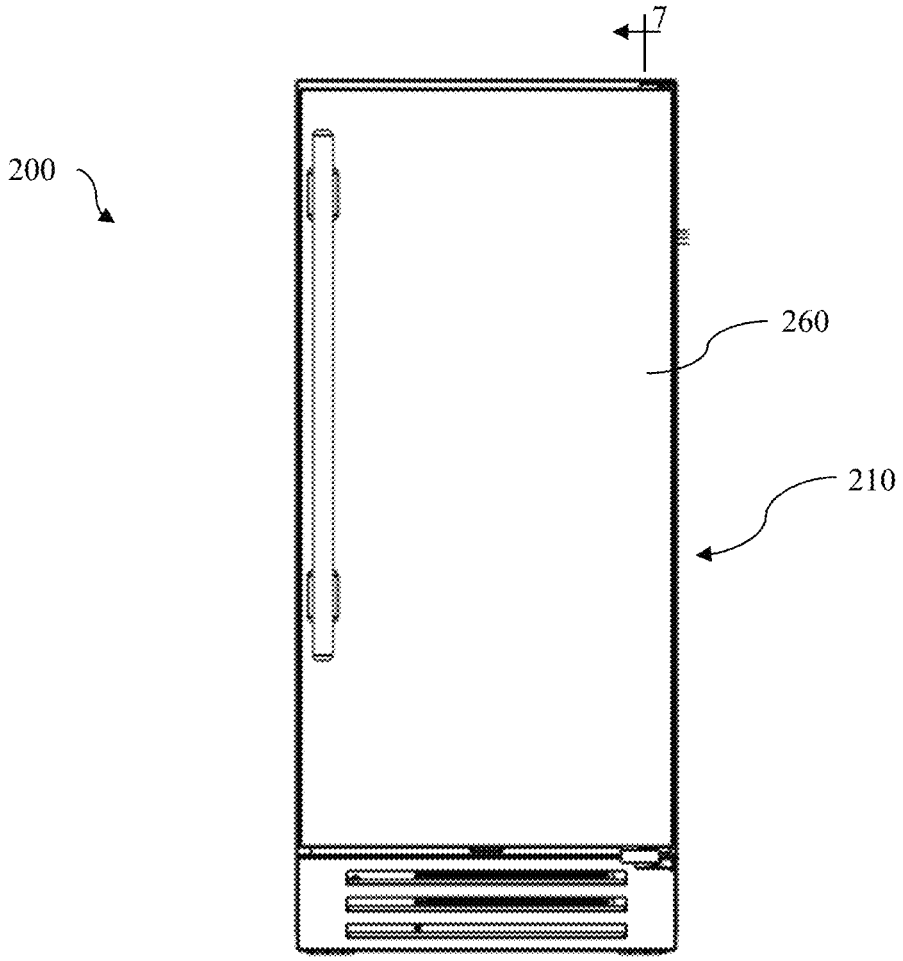
FIG. 15 is a front view of the ice maker appliance.
Figure 16:
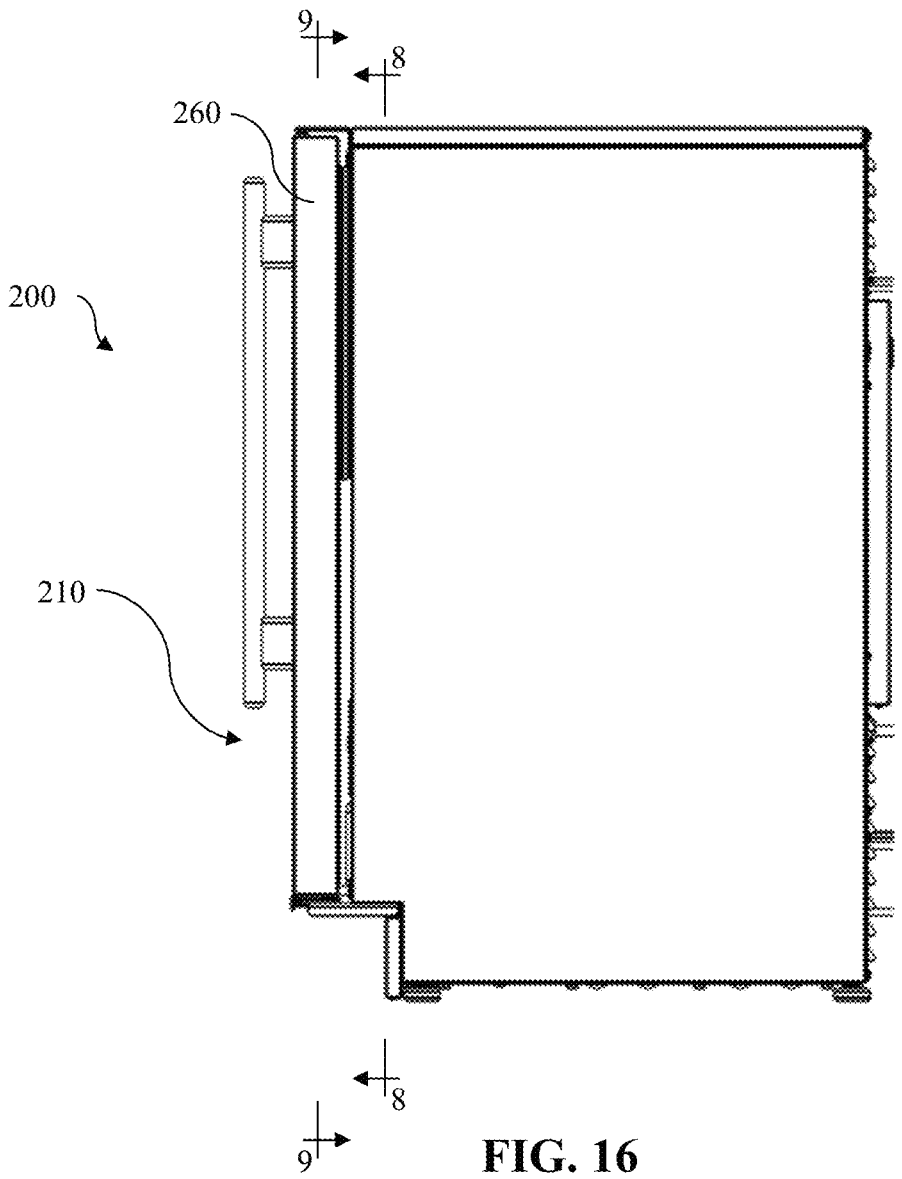
FIG. 16 is a side view of the ice maker appliance.
Figure 17:
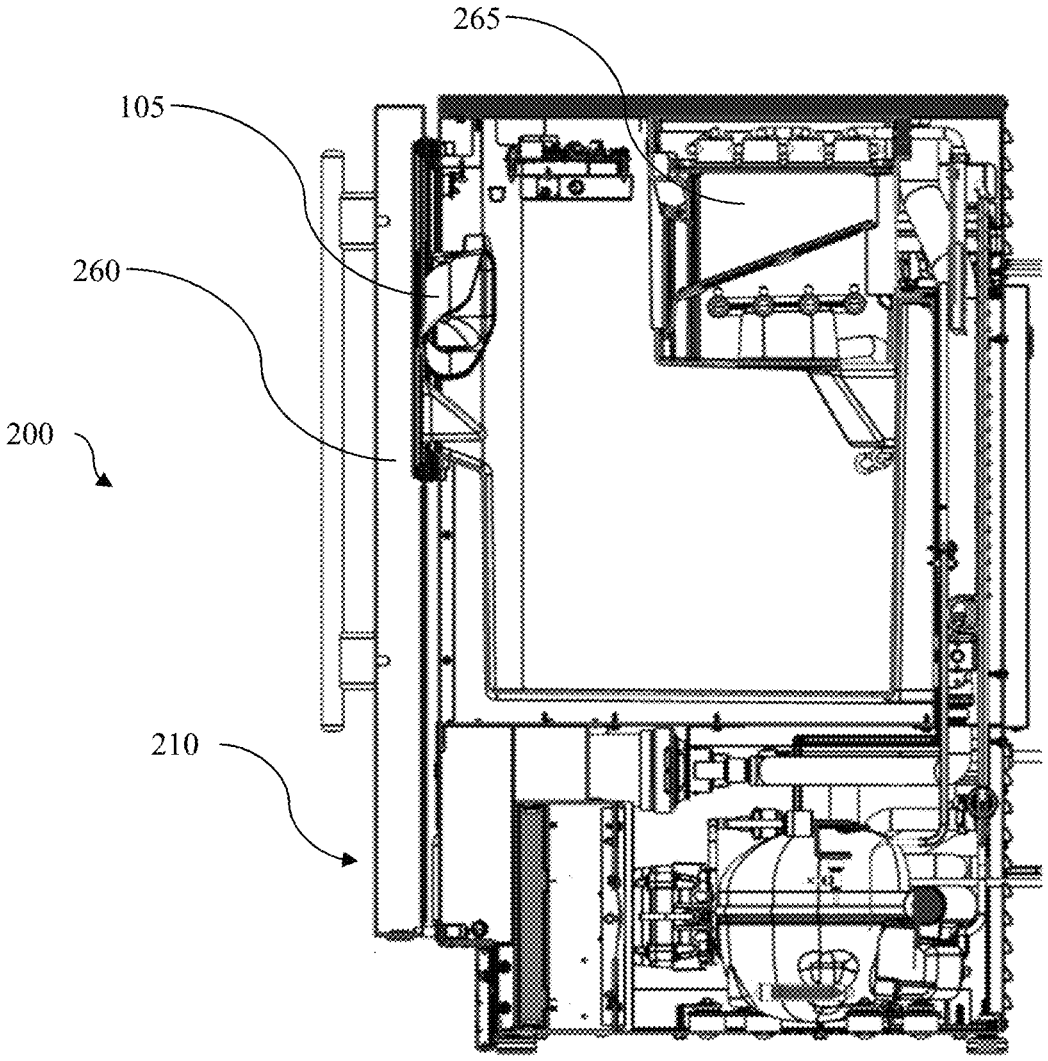
FIG. 17 is a cross section taken through the plane of line 7-7 of FIG. 15.
Figure 18:
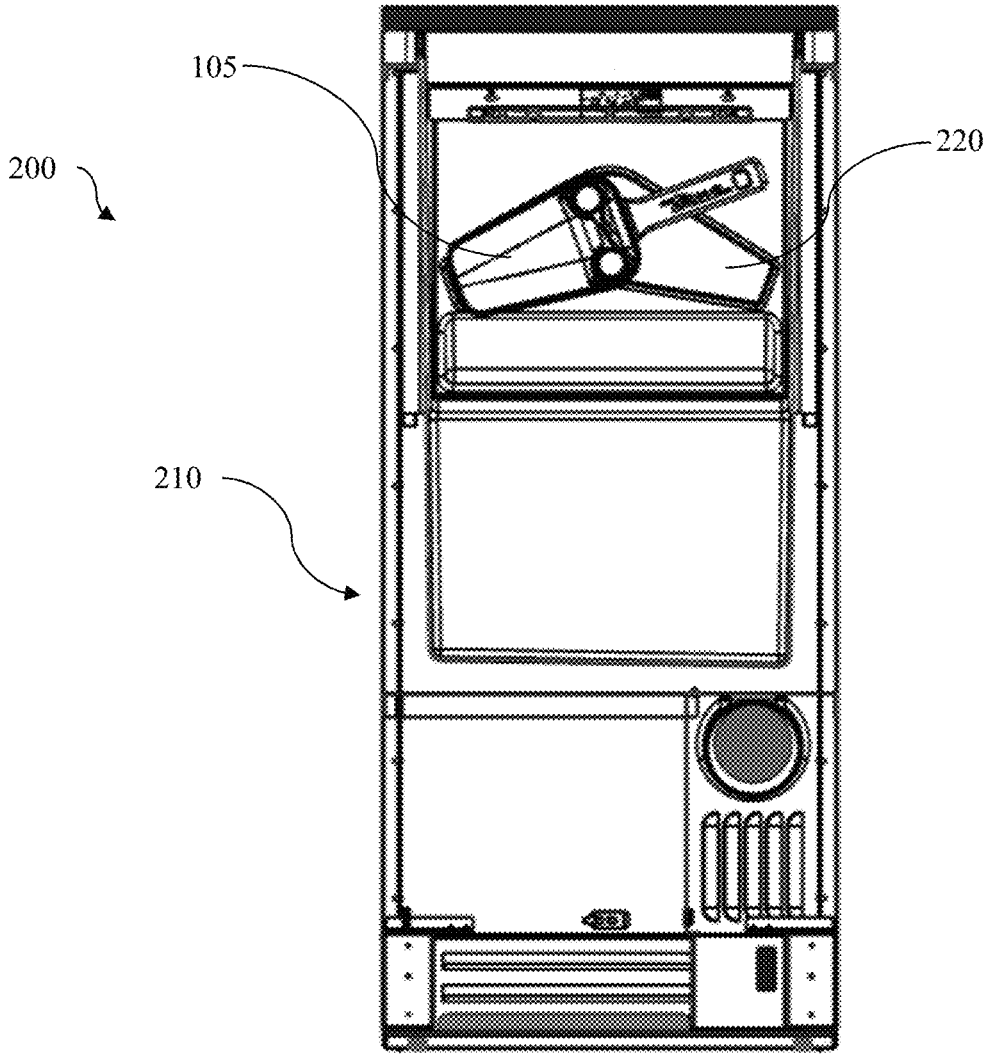
FIG. 18 is a cross section taken through the plane of line 8-8 of FIG. 16.
Figure 19:
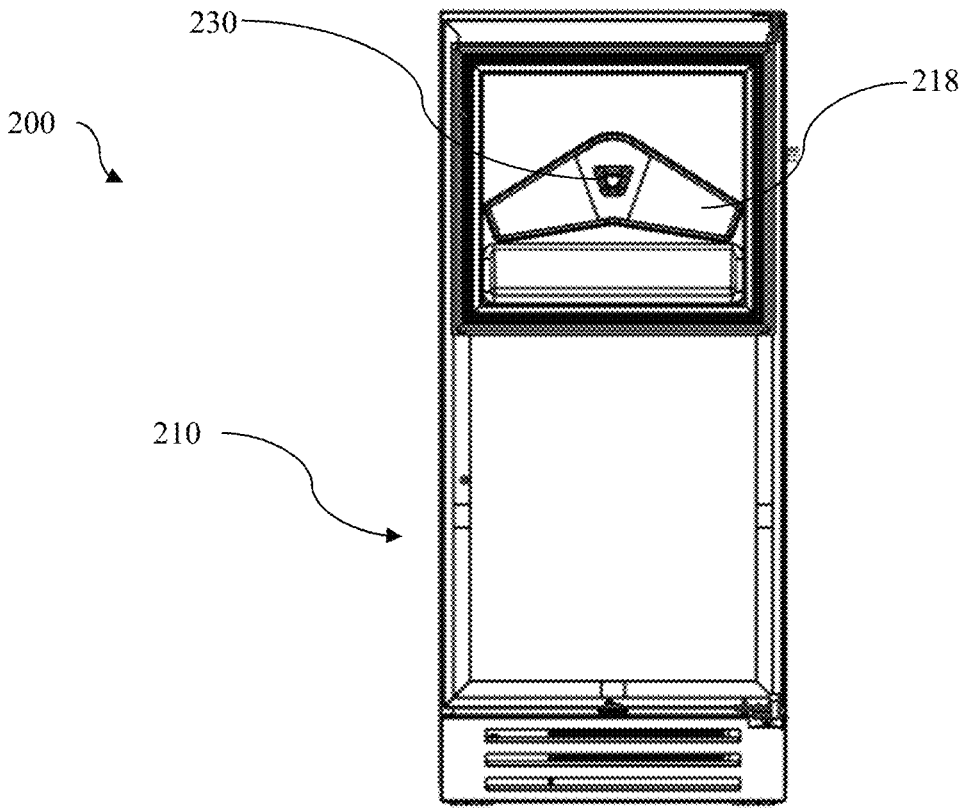
FIG. 19 is a cross section taken through the plane of line 9-9 of FIG. 16.

Referring to FIG. 13, in the illustrated embodiment the shell 118 comprises a sub-frame that supports perimeter wall panels of the shell. Each of the left and right sides of the shell 118 includes an upright frame member 150 of the sub-frame. In FIG. 13, a portion of the right panel wall is shown transparent to reveal the upright frame member 150, which would otherwise be hidden behind the panel wall. In the illustrated embodiment, the upright frame member 150 is located closer to the front of the bin 100 than the back of the bin. In one or more embodiments, the upright frame member 150 is formed from ferromagnetic material such as galvanized steel so that the scoop 105 can be supported on an exterior of the bin 100 by a force of magnetic attraction between the upright frame member and the magnetic elements 146 of the scoop. In one or more embodiments, the ferromagnetic upright frame member 150 is immediately adjacent the panel wall of the shell and is separated from the liner 120 by insulation material. By contrast, each of the support plates 130 is located immediately adjacent to the liner 120 and is spaced apart from the panel wall by insulation material. Hence, the support plates 130 enable the scoop 105 to be magnetically supported inside the bin 100, whereas the upright frame member 150 enables the scoop to be magnetically supported outside the bin.

An exemplary method of using the ice bin 100 and scoop 105 will now be briefly described below. An ice machine (not shown) is supported above the upper portion of the ice bin 100 for forming ice and depositing ice into the bin. When the ice is formed, the ice machine drops the ice through the ice drop opening 122 defined by the upper portion 114 and into the interior ice bin 100 defined by a liner 120. The liner 120 houses the ice within the interior until a future user desires its use. While in the liner 120, the ice is hindered from melting due to an insulation layer (not shown) disposed between the outer shell 118 and the liner. When the user decides to use the ice in the bin 100, the user opens the door 126. In the initial position, the scoop 105 is supported in a position on the liner 120 overlying the support plate 130. In this initial position overlying the support plate 130, the scoop 105 is also out of the path of ice being dropped through the ice drop opening 122. The scoop 105 is supported onto the liner 120 through the force of magnetic attraction between magnetic elements 146 in the scoop and the ferromagnetic material of the support plate. The user grabs the handle 138 of the scoop 105, and by applying force, overcomes the magnetic force between the magnetic elements 146 of the scoop 105 and the support plate 130 and frees the scoop from its supported position on the liner 120. The user then scoops ice out of the liner 120 using the scoop 105. The ice collects in the bowl 140 of the scoop 105 to facilitate transfer of the ice to a desired location. Once the user has dispensed the ice outside of the ice bin 100, the user places the scoop 105 in the area overlying the support plate 130 on the interior of the liner 120. In one or more embodiments, the liner 120 has a marking indicating the location of the support plate 130 so that the user can visualize where to place the scoop. The magnetic force between the magnetic elements 146 and the support plate 130 once again supports the scoop 105 on the interior of the liner 120. Alternatively, the user may utilize the scoop 105 in substantially the same way, only with the scoop being supported on the exterior surface of the outer shell 118 in the area overlying the upright support member 150.

An exemplary method of manufacturing an ice bin 100 as described above will now be briefly described below. The method includes steps of forming a liner 120, forming the outer shell 118, temporarily supporting the support plates 130 on the liner via double-sided tape, and fitting the liner in the shell and support plates in the space between the liner and the shell. The particular order of these steps is not critical. So in one or more embodiments, the liner 120 can be formed, then the support plates 130 can be temporarily secured to the liner, and then the shell can be assembled around the liner. In another embodiment, the liner 120 and outer shell 118 are each formed in suitable manufacturing processes, the support plates 130 are then temporarily secured to the liner, and then the assembly of the liner and the support plates is inserted into the shell. In yet another embodiment, the liner 120 and outer shell 118 are each formed in suitable manufacturing processes, the liner is then slipped into the outer shell, and then the plates are temporarily secured to the liner in the space between the liner and shell. Any suitable manufacturing processes can be used to form the liner 120 and the shell 118. In an exemplary embodiment, the liner 120 is formed in a blow molding process, from blow-molded plastic. The shell 118 may suitably be formed by assembling a sub-frame and then securing outer shell wall panels to the sub-frame vial suitable fasteners or mechanical tabs or hooks. As mentioned above, in an exemplary embodiment, the support plate 130 is temporarily fitted onto the liner 120 using an adhesive (e.g., a double-sided tape). After the support plate 130 is temporarily secured and the liner 120 is in the outer shell 118, an insulation layer is foamed in the space between the outer shell and the liner in order to insulate the bin 100 and permanently secure the support plate in position. For example, curable and flowable insulation material is imparted into the space so that it substantially fills the space and conforms to the support plates 130. The insulation material is then cured to provide a firm hold of the support plate 130 in the desired position.

An exemplary method of manufacturing a scoop 105 as described above will now be briefly described below. The method includes forming a scoop 105 comprising a magnetic element receiving enclosure 144 having an open end, placing a magnetic element 146 into the magnetic element receiving enclosure through the open end, and joining a cap 145 to the scoop 105 over the open end of the magnetic element receiving enclosure such that the cap retains the magnetic element in the enclosure. In one embodiment, the joining of the cap 145 comprises ultrasonic welding the cap to the scoop 105. The scoop 105 may be formed by molding the scoop, and the scoop is preferably comprised of plastic.

The inventors believe that the above-described ice bin 100 and scoop 105 provide several advantages. As compared with prior art bins in which an ice scoop was placed directly atop the ice, the bin 100 and scoop 105 of the present disclosure are believed to provide a much more sanitary way of holding the scoop at a convenient, ready-to-use position. Whereas placing a scoop directly atop ice runs a risk of transferring germs and other pathogens from a user's hands, to the scoop, and further to the ice in the bin, the illustrated ice bin 100 and scoop 105 enable the user to quickly and easily position the scoop at a ready-to-use position without direct contact with the ice. Moreover, as compared with prior art ice bins that include integrated brackets for supporting a scoop out of the way of the ice, the illustrated bin 100 and scoop 105 are believed to provide a much more convenient, user-friendly mechanism for supporting the scoop. The inventors have recognized that scoop-holding brackets inside an ice bin are often difficult to use (particularly for uses with physical limitations due to injury or disability) because they only allow the user to support the scoop at a particular location and orientation. By contrast, the illustrated support plates 130 provide a wide range of possibilities for where and how a user can support the scoop 105 on the side wall of the bin, out of contact with the ice and out of the way of ice maker operation.

Referring to FIGS. 14-19, in another embodiment contemplated to be within the scope of the present disclosure, the ice bin is integrated with the ice maker 265, as is the case with the residential-style ice maker, generally indicated at 200. The residential ice maker includes a bin body 210 comprising a front door assembly 260 configured to releasably support the magnetic scoop 105 discussed above. The illustrated door assembly 260 is configured to mount on the bin body 210 with hinges to swing open and closed. The door assembly 260 comprises a shell 218 and a liner 220 defining a space therebetween configured to receive insulation. Similar to the bin body 110 discussed above, the illustrated door assembly comprises a support plate 230 secured to the liner 220. In the illustrated embodiment the support plate 230 is configured to align with an opening through which the user withdraws ice from the ice maker appliances when the door is open. In an exemplary embodiment, the support plate 230 is temporarily secured to the liner 220 with tape and then foamed into place for a permanent installation (similar to the support plate 130 described above). As can be seen, the support plate 230 allows the magnetic scoop 105 to support itself on the door assembly 260 at a position that still allows the door to open and close. During use, the user can open the door 260, separate the scoop 105 from the door, withdraw ice from the residential ice bin 200, return the scoop to the door such that scoop is supported on the door by a force of magnetic attraction between the scoop and the door, and finally shut the door.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

What is claimed is:

1. An ice bin comprising:

a bin body, the bin body comprising a lower portion, an upper portion, and a perimeter wall extending heightwise from the lower portion to the upper portion, the upper portion of the bin body defining an ice drop area configured so that ice dropped from an ice maker supported above the ice bin is passable through the ice drop area into the interior, the bin body further comprising an ice retrieval area spaced apart from the ice drop area for providing access to the interior of the ice bin, the perimeter wall comprising a support plate configured to support an ice scoop on the perimeter wall in the interior of the ice bin by a force of magnetic attraction between the ice scoop and the support plate;

wherein the perimeter wall has a back, a front, and an inner side wall, the inner side wall having a front-to-back depth extending from the front to the back of the perimeter wall and the inner side wall having a height extending from the lower portion to the upper portion of the bin body;

wherein the perimeter wall comprises an outer shell, a liner, and an enclosed insulation space between the outer shell and the liner, the support plate being received in the enclosed insulation space along the inner side wall of the perimeter wall and the enclosed insulation space being filled with foam insulation molded-in-place between the liner and the outer shell and around the support plate;

wherein the support plate has a front edge margin, a back edge margin, and a front-to-back depth extending from the front edge margin to the back edge margin;

wherein the support plate has a top edge margin, a bottom edge margin, and a height extending from the top edge margin to the bottom edge margin;

wherein the back edge margin of the support plate is spaced apart from the back of the inner side wall by a front-to-back spacing distance;

wherein the bottom edge margin of the support plate is spaced apart from the lower portion of the bin body by a top-to-bottom spacing distance; and wherein the front-to-back spacing distance is greater than the front-to-back depth of the support plate.

2. An ice bin as set forth in claim 1, wherein the support plate is comprised of one of either a ferromagnetic material or a magnetic material.

3. An ice bin as set forth in claim 1, further comprising double-sided tape connecting the support plate to the liner.

4. An ice bin as set forth in claim 3, wherein the support plate is positioned on the front top corner of a side of the liner.

5. An ice bin as set forth in claim 4, wherein the front-to-back depth of the support plate is in an inclusive range of from about 8 inches to about 24 inches.

6. An ice bin as set forth in claim 4, wherein the liner has a front and a back and a front-to-back depth, the front-to-back depth of the support plate being at least about 10% of the front-to-back depth of the liner.

7. An ice bin as set forth in claim 4, wherein the height of the support plate is in an inclusive range of from about 12 inches to about 36 inches.

8. An ice bin as set forth in claim 4, wherein the liner has a top and a bottom and a height extending from the bottom to the top, the height of the support plate being at least about 10% of the height of the liner.

9. An ice bin as set forth in claim 1, wherein the support plate further comprises a bevel between the front edge margin and the top edge margin.

10. An ice bin as set forth in claim 9, wherein the top edge margin has a front-to-back dimension extending from the bevel to the back edge margin and wherein the front-to-back dimension is less than the front-to-back depth of the support plate; and wherein the front edge margin has a height dimension extending from the bottom edge margin to the bevel and wherein the height dimension is less than the height of the support plate.

11. An ice bin as set forth in claim 10, wherein the bevel has a bevel dimension extending from the front edge margin to the top edge margin, wherein the bevel dimension is greater than the front-to-back dimension and the height dimension.

12. An ice storage and retrieval assembly comprising, an ice bin, the ice bin comprising a bin body, the bin body comprising a lower portion, an upper portion, and a perimeter wall extending heightwise from the lower portion to the upper portion, the upper portion of the bin body defining an ice drop area configured so that ice dropped from an ice maker supported above the ice bin is passable through the ice drop area into the interior, the bin body further comprising an ice retrieval area spaced apart from the ice drop area for providing access to the interior of the ice bin, the perimeter wall comprising a support plate, and an ice scoop comprising at least one magnetic or ferromagnetic element, the scoop being configured to support itself on the perimeter wall at a location in the interior of the ice bin overlying the support plate by force of magnetic attraction between the ice scoop and the support plate;

wherein the support plate is ferromagnetic material;

wherein the perimeter wall comprises an outer shell, a liner, and an enclosed insulation space between the outer shell and the liner, the support plate being received in the enclosed insulation space and the enclosed insulation space being filled with foam insulation molded-in-place between the liner and the outer shell and around the support plate;

wherein the scoop comprises a plurality of spaced apart magnet receiving enclosures and wherein the at least one magnetic or ferromagnetic element comprises a plurality of magnetic elements, each magnetic element being received in a respective one of the magnet receiving enclosures, the scoop further comprising a plurality of caps, each cap joined to the scoop to cover a respective one of the magnet receiving enclosures and to retain the respective magnetic element in the magnet receiving enclosure.

13. An ice bin comprising:

a bin body, the bin body comprising a lower portion, an upper portion, and a perimeter wall extending heightwise from the lower portion to the upper portion, the upper portion of the bin body defining an ice drop area configured so that ice dropped from an ice maker supported above the ice bin is passable through the ice drop area into the interior, the bin body further comprising an ice retrieval area spaced apart from the ice drop area for providing access to the interior of the ice bin, the perimeter wall comprising a support plate configured to support an ice scoop on the perimeter wall in the interior of the ice bin by a force of magnetic attraction between the ice scoop and the support plate;

wherein the perimeter wall has a back, a front, and an inner side wall;

wherein the perimeter wall comprises an outer shell, a liner, and an enclosed insulation space between the outer shell and the liner, the support plate being received in the enclosed insulation space along the inner side wall of the perimeter wall and the enclosed insulation space being filled with foam insulation molded-in-place between the liner and the outer shell and around the support plate.

14. An ice bin as set forth in claim 13, further comprising double-sided tape connecting the support plate to the liner.

15. An ice bin as set forth in claim 13, wherein the liner has a front, a back, and a side extending from the front to the back, wherein the support plate is located along the side of the liner closer to the front than the back of the liner and closer to the upper portion of the bin body than the lower portion of the bin body.

16. An ice bin as set forth in claim 15, wherein the support plate has a front edge margin, a back edge margin, and a front-to-back depth extending from the front edge margin to the back edge margin.

17. An ice bin as set forth in claim 16, wherein the front-to-back depth of the support plate is in an inclusive range of from about 8 inches to about 24 inches.

18. An ice bin as set forth in claim 16, wherein the back edge margin of the support plate is spaced apart from the back of the liner by a front-to-back spacing distance and wherein the front-to-back spacing distance is greater than the front-to-back depth.

19. An ice bin as set forth in claim 15, wherein the support plate has a top edge margin, a bottom edge margin, and a height extending from the top edge margin to the bottom edge margin.

20. An ice bin as set forth in claim 19, wherein the height of the support plate is in an inclusive range of from about 12 inches to about 36 inches.

21. An ice bin as set forth in claim 19, wherein the bottom edge margin of the support plate is spaced apart from the lower portion of the bin body by a top-to-bottom spacing distance, wherein the top-to-bottom spacing distance is greater than the height of the support plate.

22. An ice bin as set forth in claim 15:

wherein the support plate has a front edge margin, a back edge margin, and a front-to- back depth extending from the front edge margin to the back edge margin;

wherein the front-to-back depth of the support plate is in an inclusive range of from about 8 inches to about 24 inches;

wherein the back edge margin of the support plate is spaced apart from the back of the liner by a front-to-back spacing distance and wherein the front-to-back spacing distance is greater than the front-to-back depth;

wherein the support plate has a top edge margin, a bottom edge margin, and a height extending from the top edge margin to the bottom edge margin;

wherein the height of the support plate is in an inclusive range of from about 12 inches to about 36 inches; and wherein the bottom edge margin of the support plate is spaced apart from the lower portion of the bin body by a top-to-bottom spacing distance, wherein the top-to-bottom spacing distance is greater than the height of the support plate.

23. An ice storage and retrieval assembly comprising the ice bin of claim 13 and an ice scoop comprising at least one magnetic or ferromagnetic element, the ice scoop being self-supporting on the perimeter wall at a location in the interior of the ice bin overlying the support plate by force of magnetic attraction between the ice scoop and the support plate.

24. An ice storage and retrieval assembly as set forth in claim 23, wherein the ice scoop comprises at least one magnet receiving enclosure and wherein the at least one magnetic or ferromagnetic element comprises a magnetic element received in each magnet receiving enclosure.

25. An ice storage and retrieval assembly as set forth in claim 24, wherein the ice scoop further comprises at least one cap, each cap joined to the ice scoop to cover a respective magnet receiving enclosure and to retain the magnetic element in the magnet receiving enclosure.

26. An ice storage and retrieval assembly as set forth in claim 24, wherein the ice scoop comprises a scoop portion and a handle portion, each magnet receiving enclosure being formed in the scoop portion.

27. An ice storage and retrieval assembly as set forth in claim 26, wherein the scoop portion has a length extending from an open end to a closed end where the handle portion joins to the scoop portion, each magnet receiving enclosure being positioned along the length of the scoop portion closer to the closed end than the open end of the scoop portion.

* * * * *